US009657398B2

(12) United States Patent
Erickson et al.

(10) Patent No.: US 9,657,398 B2
(45) Date of Patent: May 23, 2017

(54) CORROSION INHIBITING COMPOSITIONS

(71) Applicant: U.S. Water Services Inc., Saint Michael, MN (US)

(72) Inventors: Donovan L. Erickson, Stanchfield, MN (US); Roy A. Johnson, Oconomowoc, WI (US); Matthew Ryan LaBrosse, Maple Grove, MN (US); Paul R. Young, Wheaton, IL (US)

(73) Assignee: U.S. Water Services Inc., St. Michael, MN (US)

( * ) Notice: Subject to any disclaimer, the term of this patent is extended or adjusted under 35 U.S.C. 154(b) by 0 days.

(21) Appl. No.: 14/747,272

(22) Filed: Jun. 23, 2015

(65) Prior Publication Data

US 2015/0284859 A1 Oct. 8, 2015

Related U.S. Application Data

(62) Division of application No. 14/069,109, filed on Oct. 31, 2013, now Pat. No. 9,290,850.

(51) Int. Cl.

| | |
|---|---|
| ***C23F 11/14*** | (2006.01) |
| ***C23F 11/173*** | (2006.01) |
| ***C23F 11/18*** | (2006.01) |
| ***C23F 11/08*** | (2006.01) |

(52) U.S. Cl.

CPC ..... *C23F 11/144* (2013.01); *C23F 11/08* (2013.01); *C23F 11/173* (2013.01); *C23F 11/18* (2013.01); *C23F 11/187* (2013.01)

(58) Field of Classification Search

None

See application file for complete search history.

(56) References Cited

U.S. PATENT DOCUMENTS

| | | | | |
|---|---|---|---|---|
| 4,512,552 A | | 4/1985 | Katayama et al. | |
| 4,681,670 A | | 7/1987 | Nobel et al. | |
| 4,759,864 A | | 7/1988 | Van Neste et al. | |
| 4,885,136 A | * | 12/1989 | Katayama | C23F 11/08 252/389.2 |

(Continued)

FOREIGN PATENT DOCUMENTS

| | | |
|---|---|---|
| CA | 2794938 | 10/2011 |
| EP | 0 265 723 | 5/1988 |

(Continued)

OTHER PUBLICATIONS

Gowri, S. et al., Corrosion Inhabitation by Amino Acids—An Over Review, Eur. Chem. Bull. 2012, 1(11), pp. 470-476.

(Continued)

*Primary Examiner* — Joseph D Anthony

(74) *Attorney, Agent, or Firm* — Foley & Lardner LLP

(57) ABSTRACT

Compositions for inhibiting the corrosion of metals in contact with an aqueous system are provided. The corrosion inhibiting compositions may be used to maintain effective amounts of (1) an amino acid-based polymer, such as a polyaspartic acid compound, and (2) a dispersible and/or soluble tin compound in the aqueous system. The corrosion inhibiting compositions include the amino acid-based polymer and a dispersible and/or soluble tin compound and may optionally include a polycarboxylic acid chelating agent and/or a carboxylate/sulfonate functional copolymer.

23 Claims, 7 Drawing Sheets

(56) References Cited

U.S. PATENT DOCUMENTS

| | | | | |
|---|---|---|---|---|
| 4,971,724 | A | 11/1990 | Kalota et al. | |
| 5,021,324 | A | 6/1991 | Jargiello et al. | |
| 5,152,902 | A | 10/1992 | Koskan et al. | |
| 5,178,786 | A | 1/1993 | Jahnke et al. | |
| 5,202,058 | A | 4/1993 | Riggs, Jr. | |
| 5,344,590 | A | 9/1994 | Carter et al. | |
| 5,373,086 | A | 12/1994 | Koskan et al. | |
| 5,478,919 | A | 12/1995 | Koskan et al. | |
| 5,484,860 | A | 1/1996 | Wood et al. | |
| 5,487,906 | A | 1/1996 | Dixit et al. | |
| 5,494,995 | A | 2/1996 | Wood et al. | |
| 5,510,057 | A | 4/1996 | Riggs | |
| 5,523,023 | A | 6/1996 | Kleinstuck et al. | |
| 5,525,257 | A | 6/1996 | Kleinstuck et al. | |
| 5,531,934 | A | 7/1996 | Freeman et al. | |
| 5,607,623 | A | 3/1997 | Benton et al. | |
| 5,616,544 | A | 4/1997 | Kalota et al. | |
| 5,639,832 | A | 6/1997 | Kroner et al. | |
| 5,776,875 | A | 7/1998 | Tang et al. | |
| 5,785,896 | A | 7/1998 | Rother et al. | |
| 5,942,052 | A | 8/1999 | Kamimura et al. | |
| 5,981,691 | A * | 11/1999 | Sikes | C08G 73/1092 525/432 |
| 5,989,322 | A | 11/1999 | Riggs, Jr. | |
| 6,001,156 | A | 12/1999 | Riggs, Jr. | |
| 6,022,401 | A | 2/2000 | Tang et al. | |
| 6,200,529 | B1 | 3/2001 | Riggs, Jr. | |
| 6,207,079 | B1 * | 3/2001 | Kmec | C02F 5/14 210/697 |
| 6,238,621 | B1 | 5/2001 | Kalota et al. | |
| 6,277,302 | B1 * | 8/2001 | Fan | C09K 15/02 252/389.52 |
| 6,355,771 | B1 | 3/2002 | Oda | |
| 6,416,712 | B2 | 7/2002 | Riggs, Jr. | |
| 6,432,220 | B1 | 8/2002 | Lindemann et al. | |
| 6,447,717 | B1 | 9/2002 | Fan et al. | |
| 6,464,900 | B1 | 10/2002 | Kmec et al. | |
| 6,503,400 | B2 | 1/2003 | Kmec et al. | |
| 6,620,338 | B2 | 9/2003 | Fan et al. | |
| 6,649,071 | B2 | 11/2003 | Stapp | |
| 6,706,670 | B2 | 3/2004 | Kalota et al. | |
| 7,014,694 | B1 | 3/2006 | Miksic et al. | |
| 7,325,603 | B2 | 2/2008 | Kotlar et al. | |
| 8,246,857 | B2 | 8/2012 | Guzmann et al. | |
| 8,822,390 | B2 | 9/2014 | Heath et al. | |
| 2001/0022947 | A1 * | 9/2001 | Riggs, Jr. | C02F 1/683 422/14 |
| 2006/0118761 | A1 | 6/2006 | Stapp | |
| 2012/0282136 | A1 | 11/2012 | Richardson et al. | |
| 2013/0023449 | A1 | 1/2013 | Heath et al. | |
| 2015/0004054 | A1 | 1/2015 | Richardson et al. | |

FOREIGN PATENT DOCUMENTS

| | | |
|---|---|---|
| EP | 0 311 192 | 4/1989 |
| WO | WO 00/23552 | 4/2000 |
| WO | WO 02/49966 | 6/2002 |

OTHER PUBLICATIONS

Mueller et al., Amino and polyamino acids as corrosion inhibitors for aluminium and zinc pigments, Pigment and Resin Technology, 2002, 31(2), pp. 84-87.

Ornek et al., Pitting corrosion inhibition of aluminum 2024 by Bacillus biofilms secreting polyaspartate or y-polyglutamate, Applied Microbiology and Biotechnology, 2002, 58(5), pp. 651-657.

Silverman, D.C., et al., Effect of pH on Corrosion Inhibition of Steel and Polyaspartic Acid, Corrosion, Nov. 1995, 51(11), pp. 818-825.

Bain et al., Field Studies with a New Environmentally Acceptable Scale and Corrosion Inhibitor, Corrosion 2003, Paper No. 03276, Mar. 2003, 23 pages.

Bain et al., The Use of Polyaspartates for Scale and Corrosion Control in Open Recirculating Cooling Systems, Proceedings of the AWT Meeting, Oct. 1998, Washington D.C., 24 pages.

Fan et al., Scale and Corrosion Inhibition with Thermal Polyaspartates, Corrosion 99, Paper No. 120, Mar. 1999, 21 pages.

Nanochem Solutions, Inc., NanoChem DB-105 N60 Technical Bulletin, Oct. 1, 2011, 2 pages.

LaBrosse et al., "The Pursuit of a Green Carbon Steel Corrosion Inhibitor," Presentation at Association of Water Technologies (AWT) 2012 Annual Meeting, Palm Springs, CA, Sep. 19-22, 2012, 25 pps.

A.S. Inc. Website, 01CLaboratory Tests Conducted at the University of Minnesota01D, Retrieved from: http://www.asi-corrosioncontrol.com/labtests1.htm.

Amador, Elizabeth M., Abstract for Master of Science Thesis, University of Minnesota, 01CLead Corrosion Study for the Saint Paul Regional Water Services,01D Retrieved from: http://www.asi-corrosioncontrol.com/Thesis_esbri.pdf.

Hozalski et al., 01CAn Investigation of Stannous Chloride as an Inhibitor of Lead Corrosion,01D Retrieved from: http://www.waterrf.org/ExecutiveSummaryLibrary/3174_Executive_Summary.pdf.

International Search Report and Written Opinion regarding International Appl. No. PCT/US2014/061081, mail date Jan. 5, 2015, 10 pages.

Stapp, et al., 01CA Case History of a New, Green Water treatment Program Containing a Tin-based Corrosion Inhibitor,01D 2007, Retrieved from: http://www.asi-corrosioncontrol.com/AWT%20presentation%202007.pdf.

Stapp, et al., 01CTwo Looks at Water System Corrosion Control Using Tin Technology01D, Water World, vol. 10 Issue 1. Retrieved from: http://www.waterworld.com/articles/iww/print/volume-10/issue-1/featu re-editorial/two-looks-at-water-system-corrosion-control-using-tin-technology.html.

V. Jovancicevic, and D. Hartwick, Recent Developments in Environmentally-Safe Corrosion Inhibitors, Corrosion, 1996, 96-226.

* cited by examiner

HARD WATER A CORROSION COUPON RESULTS

| TREATMENT | DOSAGE (ppm) | CARBON STEEL COUPON |
|---|---|---|
| CONTROL | - | |
| $PO_4$/TKPP | 3.0/1.0 | |
| $PO_4$/Zn | 5.0/1.0 | |
| AAP | 30.0 | |
| HPA | 15.0 | |
| PCA | 15.0 | |

FIG. 2

HARD WATER B CORROSION COUPON RESULTS

| TREATMENT | DOSAGE (ppm ACTIVE) | CARBON STEEL COUPON |
|---|---|---|
| CONTROL | - | |
| AAP | 15 | |
| PCM | 15 | |
| EPOC | 15 | |

SYNERGY OF SnC12 AAP COMBINATION

MS Cu

CORROSION INHIBITING COMPOSITIONS

CROSS-REFERENCE TO RELATED APPLICATIONS

This application is a divisional of U.S. patent application Ser. No. 14/069,109, filed on Oct. 31, 2013, the entire contents of which are hereby incorporated by reference, for any and all purposes.

BACKGROUND

Organic and inorganic corrosion inhibitors have been used for many years to reduce corrosion of metals in contact with aqueous systems, such as mild steel in industrial heat exchange equipment and/or copper and copper alloys in contact with water treatment systems. It is important that such inhibitors used for corrosion protection be as safe to use as possible and be environmentally friendly. Over the years, the pursuit of a "green" corrosion inhibitor has led to the introduction of a variety of commercial products based on different inhibitor chemistries. The use of many of these chemistries has since been restricted by evolving environmental regulations.

Oxidizing biocides like sodium hypochlorite are used to reduce biological problems in cooling systems. This can minimize loss of heat transfer and health related issues like *Legionella pneumophila*. Formation of biological slimes can lead to under-deposit corrosion and efficiency loss due to a combination of organic and inorganic scale deposits. Although oxidizing biocides perform the necessary function of minimization of biological problems, they are also known to reduce the efficiency of some scale and corrosion inhibitors.

There is a continuing need for safe and effective water treatment agents which can be used to control corrosion, particularly when a substantial concentration of dissolved calcium is present in the system water. Water treating agents of this type are particularly advantageous when they are substantially free of heavily regulated metals, such as chromate, zinc and molybdate. Such treatment agents should desirably be able to function without substantially decreased performance in the presence of the type of oxidizing materials, such as sodium hypochlorite, that are often added as a biocide to water treatment and handling systems.

SUMMARY

The present application relates to methods and compositions for inhibiting the corrosion of metals, such as ferrous metals, aluminum and its alloys, copper and its alloys, lead, or solder, in contact with aqueous systems. For many applications the present corrosion inhibiting compositions are desirably substantially free of heavily regulated metals, such as chromate, zinc and molybdate. For some applications, the use of a corrosion inhibitor treatment which contains very low levels or is substantially free of phosphate and polyphosphate materials may be preferred. In addition, for some applications, it may be advantageous to use a corrosion inhibitor treatment that is substantially free of organophosphonate compounds (e.g., free of organophosphonate corrosion and/or scale inhibitors). As used herein the term "substantially free of" refers to a composition which contains less than about 0.1 wt. % (based on the total weight of the composition) of the component (material or compound) specified. When the term "substantially free of" is used in reference to a treated aqueous system, as used herein the term refers to a system which contains less than about 0.1 ppm of the component (material or compound) specified.

The present application provides a method of inhibiting corrosion of one or more metals in contact with an aqueous system, where the method comprises maintaining effective amounts of (a) an amino acid-based polymer, such as polyaspartic acid, and (b) dispersible and/or soluble tin compound in the aqueous system. The metals in contact with such aqueous systems are commonly ferrous metals but the system may also be in contact with other metals, such as aluminum, aluminum alloys, copper, copper alloys, lead, and/or solder. The corrosion inhibiting components employed in the present method may be added simultaneously or separately into the water of the aqueous system, i.e., provided either in a single treatment product or as separate products.

There have been a number of reports that amino acid-based polymers, such as polyaspartic acid, exhibit corrosion inhibiting activity. As exemplified by the results for polyaspartic acid shown in Examples 1 and 2 herein, however, the corrosion inhibiting activity exhibited by amino acid-based polymers is generally very weak and not comparable to the protection provided by commercially accepted corrosion inhibitors for water treatment systems. Corrosion inhibiting treatments employing stannous salts in combination with a number of different other additives have also been reported. The performance of such combinations has however, been such that none of these have found wide commercial acceptance. The present application describes the surprising synergistic results documented by the present application for corrosion inhibiting combinations including an amino acid-based polymer, such as polyaspartic acid, and dispersible and/or soluble tin compound, such as a stannous salt.

The present corrosion inhibiting compositions, which may be effectively employed in the present methods commonly include (1) an amino acid-based polymer, such as a polyaspartic acid compound; and (2) dispersible and/or soluble tin compound, such as stannous oxide and/or a water soluble stannous salt. In one suitable example, the corrosion inhibiting composition may include effective amounts of (1) a polyaspartic acid compound and (2) a tin salt, e.g., a stannous salt such as a stannous halide and/or a stannous carboxylate. In many embodiments, the corrosion inhibiting composition is substantially free of zinc or molybdate or chromate (i.e., contains no more than about 0.1 wt. % of composition).

The amino acid-based polymer can have an acidic amino acid residue content in the range of about 20 to 100 mole percent. For example, the utilized polymeric component can be polyaspartic acid, polyglutamic acid or a block or random copolymer containing (a) at least one amino acid derived moiety selected from the group consisting of aspartic acid and glutamic acid, and, optionally, (b) one or more comonomers selected from the group consisting of polybasic carboxylic acids and anhydrides, fatty acids, polybasic hydroxycarboxylic acids, monobasic polyhydroxycarboxylic acids, amines, di and triamines, polyamines, hydroxyalkyl amines, carbohydrates, sugar carboxylic acids, amino acids, non-protein forming aminocarboxylic acids, lactams, lactones, diols, triols, polyols, unsaturated dicarboxylic and tricarboxylic acids, unsaturated monocarboxylic acids, derivatized aspartic acid residues, and derivatized glutamic acid residues. In such copolymers the mole percent of the sum of the aspartic and/or glutamic acid residues is at least about 20% of the total number of subunits in the polymer, more commonly at least about 60%, at least about 70%, or at least about 80% and, in some embodiments, at least about 90% of the total number of polymer subunits. Particularly suitable acidic amino acid polymers useful in the compositions and methods of the present invention include polyaspartic acid, polyglutamic acid, and salts and copolymers of aspartic and glutamic acid where these amino acids make up at least about 80% and, often, at least about 90% of the total polymer subunits. Illustrative of the salts is sodium polyaspartate. The extent that such polymers exist in a salt or partial salt form will be a function of the pH of the composition or aqueous system. For example, when compositions including an acidic amino acid polymer are used to treat aqueous systems having a system pH of 7 or higher, a substantial fraction but typically not all of the carboxylic acid groups will be present in a salt form.

The present corrosion inhibiting compositions may be used in any system where water primarily in its liquid form is in contact with one or more corrodible metals. These metals may contain a plurality of iron or its alloys (ferrous metals), or other metals including aluminum and its alloys, copper and its alloys, lead, or solder. Examples of water systems where the present corrosion inhibiting compositions may be employed include, without limitation, open recirculating cooling systems, closed loop heating or cooling systems, radiators, water heaters, boilers, storage tanks, pipes, sprinkler systems, distribution systems for drinking water, irrigation water, washwater or firefighting water, and the like. The pH of the aqueous component in such water systems is typically in the range of about 6.5 to 10, commonly about 7 to 9.5 and very often about 8 to 9.5. Typically, the pH of the water in such systems is maintained above about 7.5. The corrosion inhibiting components employed in the present method are generally provided at the same time into the water of the water system, whether added simultaneously or separately, and whether provided in a single treatment product or as separate products. While the corrosion inhibiting composition may be added at periodic intervals, very often the corrosion inhibitor is added to the system on a substantially continuous basis so as to maintain a relatively constant concentration of the corrosion inhibitor in the system water.

The present corrosion inhibiting compositions and methods can be employed in water systems having a wide range of hardness, e.g., in aqueous systems having a hardness (expressed as ppm CaCO3) that can range from 10 to about 1,200. The examples provide herein provide illustrations of the effective use of the present corrosion inhibitors in both a low hardness industrial water system (hardness of circa) and in a synthetic test water with a hardness of about 650-700.

BRIEF DESCRIPTION OF THE DRAWINGS

For a more complete understanding of the features and advantages of the present method and composition, reference is now made to the detailed description section along with the accompanying figures and in which:

FIG. 2 depicts mild steel corrosion coupon results in a comparison of a phosphate/polyphosphate corrosion inhibitor (PO4/TKPP), a hydroxyphosphonic acid (HPA), a commercial phosphonocarboxylic acid corrosion inhibitor (PCA), a phosphate/zinc treatment (PO4/Zn), and polyaspartic acid (aspartic acid polymer—"AAP") from a test conducted in Hard Water A.

DETAILED DESCRIPTION

Figure 1:
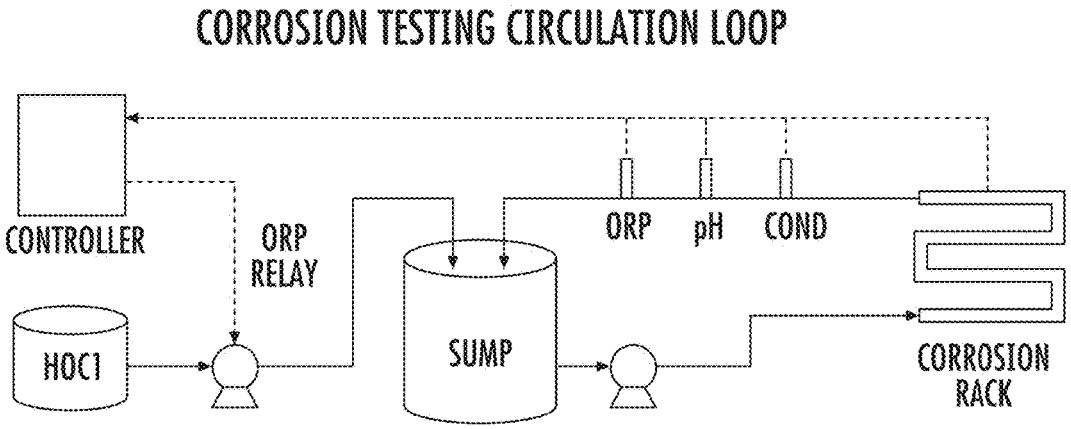
FIG. 1 is a schematic depiction of the circulation loop water treatment system used in the corrosion inhibition tests described herein.

While making and using various embodiments of the present method and composition are discussed in detail below, it should be appreciated that the present application provides many applicable inventive concepts that can be embodied in a wide variety of specific contexts. The specific embodiments discussed herein are merely illustrative of specific ways to make and use the present method and apparatus and are not intended to limit the scope of the invention.

The present application provides a method of inhibiting corrosion of one or more metals in contact with an aqueous system, where the method comprises maintaining effective amounts of (a) an amino acid-based polymer, such as polyaspartic acid, and (b) dispersible and/or soluble tin compound in the aqueous system. The method typically includes adding an effective amount of a corrosion inhibitor composition to the aqueous system, where the composition includes a polyaspartic acid compound and a water soluble tin salt, e.g., a water soluble stannous salt. The corrosion inhibitor composition may optionally include a polycarboxylic acid chelating agent and/or a carboxylate/sulfonate functional copolymer. In many embodiments, the method may desirably use a corrosion inhibiting treatment that is substantially free of zinc, molybdate or chromate (i.e., addition of the corrosion inhibitor introduces no more than about 0.1 ppm of such metal ions as diluted into a treated aqueous system).

The tin compounds employed in the present corrosion inhibiting compositions may be provided in a form which is soluble and/or dispersible in the water system. This may suitably be either in the stannous Sn(II) form or the stannic Sn(IV) form. The tin compounds are commonly introduced in the form of a stannous salt, but this does not preclude the presence of tin in the +4 oxidation state (stannic tin), since tin in the +2 oxidation state is known to convert readily to the +4 oxidation state. Accordingly, in some embodiments, the present corrosion inhibiting compositions may include a stannic salt. Without wishing to be bound by hypothetical mechanisms, it may well be that the presence of some amount of stannic tin in the treated water system is beneficial to corrosion inhibition. Solutions of Sn(II) salts may be unstable as a result of oxidation and/or hydrolysis reactions. Once oxidized to Sn(IV), the Sn(IV) species may be even more susceptible to hydrolysis. The inclusion of chelating agents in the corrosion inhibitor formulation may serve to retard or reverse hydrolysis. It may also be useful to include antioxidants, radical scavengers or other means of protecting the tin species from oxidation in a corrosion inhibitor formulation. Compounds to prevent or retard the oxidation of Sn+2 to Sn+4 are known in the art. For example, antioxidants, such as ascorbic acid and hydroquinone, and/or radical scavengers, such as sorbitol and t-butanol, may suitably be included in the present corrosion inhibitor formulations to aid in enhancing their stability.

The present corrosion inhibiting compositions commonly include a tin salt, which may be provided in a soluble and/or dispersible form. For example, the tin salt may suitably have a solubility in water of at least 0.1 wt. % (as measured at 25 C). Examples of suitable stannous salts include stannous halides, e.g., stannous chloride, stannous bromide, stannous fluoride, and stannous iodide. Other suitable stannous salts include stannous phosphates, stannous carboxylates and/or stannous sulfate. The stannous carboxylates may be salts of an organic mono-carboxylic acid, e.g., a mono-carboxylic acid having 1 to 16 carbon atoms, more commonly 1 to 8 carbon atoms. Suitable examples include stannous acetate, stannous butyrate, stannous octanoate, stannous hexadecanoate, and the like. Suitable dispersible forms of the tin salt may include stannous oxide.

In particular embodiments, the stannous salt may suitably include a stannous halide, such as stannous chloride. The concentration of the stannous salt in the system water under treatment may be at a final diluted concentration of about 0.05 to 50 ppm, desirably about 0.1 to 20 ppm, commonly about 0.1 to 10 ppm and often about 0.2 to 5 ppm (expressed as concentration of "tin," e.g., 1.0 ppm "tin" is the equivalent of maintaining a concentration of ~1.7 ppm stannous chloride in the system water being treated).

The present corrosion inhibiting compositions and methods often include a polyaspartic acid compound in combination with a tin compound. As used herein, the term "polyaspartic acid compound" refers to copolymers in which the mole percent of the aspartic acid residues is at least about 20% of the total number of subunits in the polymer. Very often, the mole percent of the aspartic acid residues is at least about 60%, at least about 70%, or at least about 80% of the total number of subunits in the polyaspartic acid compound. The preparation of polyaspartic acid (also referred to herein as "AAP") and related amino acid based polymers is well known in the art (collectively referred to herein as "amino acid-based polymers)". As used herein, the term "polyaspartic acid" refers to polymers and copolymers in which at least about 80% of the subunits of the polyaspartic acid are alpha- and/or beta-aspartic acid subunits.

In a suitable embodiment, polyaspartic acid compounds may be prepared by subjecting the monoammonium salt of maleic acid to a thermal polymerization, often under continuous processing conditions, typically at about 150 to 180° C. The resulting polysuccinimide can then be converted by hydrolysis to polyaspartic acid or a salt thereof. The preparation of polyaspartic acid can also be carried out by thermal polycondensation of aspartic acid see, e.g., (J. Org. Chem. 26, 1084 (1961)). The preparation of polyaspartic acid from maleic anhydride, water and ammonia has also been reported (see, U.S. Pat. No. 4,839,461). Suitable examples of commercially available polyaspartate products include Scale-Tek BIO-D 2100 available from Global Green Products, LLC and DB-105 available from NanoChem Inc.

In the present polyaspartic acid compounds, the proportion of aspartic acid subunits in the beta-form is commonly more than about 50%, and often more than about 70%. In many suitable embodiments, in addition to the repeating polyaspartic acid units, the present polyaspartic acid compounds may also include other repeating units, e.g. malic acid subunits, maleic acid subunits, and/or fumaric acid subunits. In some embodiments, the polyaspartic acid compounds may also include unhydrolyzed succinimide subunits. Commonly, at least about 80% and desirably at least about 90% of the subunits of a suitable polyaspartic acid compound are alpha- and/or beta-aspartic acid subunits.

The present polyaspartic acid compounds may also include a minor amount (typically no more than about 20% and commonly no more than about 10% of the subunits) of the subunits of the polymer based on one or more comonomers, such as glutamic acid, polybasic carboxylic acids, fatty acids, polybasic hydroxycarboxylic acids, monobasic polyhydroxycarboxylic acids, and sugar carboxylic acids.

Suitable polyaspartic acid compounds may have a molecular weight according to gel-permeation chromatographic analysis of about 1,000 to 50,000, about 1,000 to 10,000, commonly about 2,000 to 7,000, and often about 2,000 to 6,000.

Suitable polyaspartic acid compounds also include copolymers prepared by polymerization of maleic acid and ammonia with a diamine or triamine, followed by hydrolysis with base (see, e.g., U.S. Pat. No. 5,510,427). Other polyaspartic acid compounds may be prepared by polymerization of maleic acid, ammonia and a polycarboxylic acid, and optionally with a diamine or triamine (see, e.g., U.S. Pat. No. 5,494,995).

Other examples of polyaspartic acid compounds include copolymers of polyaspartic acid produced by reacting maleic acid, a polycarboxylic acid, ammonia and a polyamine and hydrolyzing and converting the resultant polymer into a salt with an alkali hydroxide (see, e.g., U.S. Pat. No. 5,484,860). Suitable polycarboxylic acids for use in such a process include adipic acid, citric acid, fumaric acid, malic acid, malonic acid, succinic acid, glutaric acid, oxalic acid, pimelic acid, itaconic acid, nonanedioic acid, dodecanedioic acid, octanedioic acid, isophthalic, terphthalic and phthalic acid. Suitable polyamines typically include at least one primary amino group, e.g., polyamines such as diethylene triamine, polyoxyalkyleneamine diamines and triamines, melamine, alkyl diamines (e.g., ethylene diamine and hexanediamine) and alkyl triamines.

The polyaspartic acid compound may also be a polymerisation product of aspartic acid, optionally in form of a copolymerisate with fatty acids, polybasic carboxylic acids, anhydrides of polybasic carboxylic acids, polybasic hydroxycarboxylic acids, monobasic polyhydroxycarboxylic acids, alkoxylated alcohols, alkoxylated amines, amino sugars, carbohydrates, sugar carboxylic acids and polymers thereof. The polyaspartic acid compound may also be a modified polyaspartic acid produced by reacting mercapto amine precursor, mercapto amine, and/or salt of mercapto amine with an anhydro polyaspartic acid. Suitable polyaspartic acid compound may also include polymers produced by reaction of polyaspartimides with amino acids, alkanolamines and/or aminated fatty alcohol alkoxylates. The aminated fatty alcohol alkoxylates may be aminated ethylene oxide and/or propylene oxide alkoxylates of C1-C20 fatty alcohols. Other examples of suitable polyaspartic acid compounds include modified poly(aspartic acid) polymers which include modified polyaspartic acid subunits, such as polyaspartic acid modified through partial amidation with amino compounds, such as alkoxylated amines, alkanolamines, alkylamines and/or polyalkylenepolyamines.

In many instances, it may be advantageous to include a polycarboxylic acid chelating agent in the present corrosion inhibiting composition. The polycarboxylic acid chelating agent may be an aminopolycarboxylate, a hydroxy-polycarboxylic acid and/or a low molecular weight polycarboxylic acids and/or a salt of such compounds. Examples of suitable polycarboxylic acids include succinic acid, glutaric acid, low molecular weight polymaleic acids and/or salts thereof. Examples of suitable aminopolycarboxylates include glutamic acid (GLDA), methylglycinediacetic acid (MGDA), ethylenediamine tetraacetic acid (EDTA), L-aspartic acid N,N-diacetic acid (ASDA), sodium diethanolglycine/2-hydroxyethyliminodiacetic acid, disodium salt (DEG/HEIDA), iminodisuccinic acid (IDS), nitrilotriacetic acid (NTA), ethylenediaminedisuccinic acid (EDDS), diethylenetriamine pentaacetic acid (DETPA) and/or salts thereof. Examples of suitable hydroxy-polycarboxylic acids include citric acid, hydroxy-succinic acid, tartaric acid and/or salts thereof.

Other complexing agents (i.e., molecules with at least two moieties capable of forming coordinate bonds with metal ions—"polydendate ligands") may optionally be included in the present compositions. The coordination generally occurs through highly electronegative atoms such as oxygen or nitrogen, sometimes phosphorous and/oror sulfur. Examples include diamines such as ethylene diamine and diethylenetriamine. Examples of suitable sulfur containing chelating agents include dimercaptosuccinic acid (DMSA) and dimercapto-propane sulfonate (DMPS).

The corrosion inhibiting composition may also include a polycarboxylate polymer or copolymer and/or a carboxylate/sulfonate functional copolymer. For example, the corrosion inhibiting composition may include at least one additional component selected from the group consisting of acrylic/sulfonic copolymers, polymaleic acid, and acrylic/maleic copolymers.

Polymers and copolymers based on acrylic acid, methacrylic acid, maleic acid, and/or sulfonated monomers, such as acrylamidosulfonic acid (AMPS), sodium styrenesulfonate (SSS) and/or sulfophenylmethallyl ether (SPME) are commonly employed in water treatment applications and are suitable for use in the present corrosion inhibition compositions and methods. As employed herein, the term "copolymer" refers to polymers formed from two, three or more monomers and polymers having two, three or more differing subunits in their polymer backbone. The present compositions may include (meth)acrylic polymers, e.g., acrylic acid homopolymers, methacrylic acid homopolymers, and/or copolymers formed from mixtures including these two monomers. Examples of suitable homopolymers are polyacrylates, such as Carbosperse K-700 available from Lubrizol, GOOD-RITE K-732 available from B.F. Goodrich and KemGuard 5802 available from Kemira, or polymaleates such as BelClene 200 available from BWA Water Additives.

Other examples of suitable polymers for inclusions in the present corrosion inhibiting compositions include copolymers comprising subunits based on acrylic acid (or other suitable carboxylic functional monomers, such as methacrylic acid and/or maleic acid) copolymerized with acrylamidosulfonic acid and/or sulfonated sodium styrene monomers (also referred to herein as "carboxylate/sulfonate functional copolymers"). Specific examples of carboxylate/sulfonate functional copolymers which may be included in the present compositions include maleic acid/styrene sulfonic acid (MA/SS) available as Versa TL-4 (Akzo Chemical), acrylic acid/acrylamidosulfonic (AA/AMPS) available as Kemguard 5840 from Kemira, acrylic acid/acrylamidosulfonic acid/terbutylacrylamide (AA/AMPS/TBAM) available as ACCUMER 3100 (Rohm and Haas) and acrylic acid/AMPS/sodium styrenesulfonate (AA/AMPS/SSS) available as Carbosperse K-797 (Lubrizol).

Examples of further components which may be present in the corrosion inhibitor compositions include:

Azole corrosion inhibitors, such as benzotriazole, an alkylbenzotriazole (e.g. tolyltriazole) and/or mercaptobenzothiazole, particularly in systems which include exposure of copper or copper alloy to the system water under treatment.

Phosphonic acid-functional corrosion inhibiting and/or scale inhibiting agents, such as hydroxyphosphonic acids, e.g., 1-hydroxyethane-1,1-diphosphonic acid (otherwise known as 1-hydroxyethylidene-1,1-diphosphonic acid or HEDP), phosphonocarboxylic acids, such as hydroxyphosphonoacetic acid and/or phosphonobutane-tricarboxylic acid, and aminophosphonic acids, such as nitrilo tris (methylenephosphonic acid) (NTP), may also be included in the present corrosion inhibitor compositions.

Nonionic surfactants such as a polysorbate surfactant (also referred to as "fatty acid ester(s) of ethoxylated sorbitan") may also be included in the present corrosion inhibitor compositions. Polysorbate surfactants are polyoxyethylene derivatives of a sorbitan monocarboxylate (where the carboxylate group is typically a long chain fatty ester group having about 14 to 20 carbon atoms). An example of a suitable polysorbate surfactant for use in the present compositions is mono-octadecaneoate poly (oxy-1,2-ethanedlyl) sorbitol, which may include about 8 to 50 and commonly about 15 to 25 (1,2-ethanediyl) groups. In some embodiments, the present corrosion inhibitor compositions may include an ionic surfactant, such as a sulfonated surfactant, such as sodium n-octane sulfate and sodium 2-ethylhexylsulfate.

Biocides such as chlorine, NaOCl, NaOBr, isothiazolinones, glutaraldehyde, sulfamic acid-stabilized bleach and/or sulfamic acid-stabilized bromine are also commonly used to treat aqueous systems, such as an industrial cooling water system. Such biocides are typically introduced separately into the aqueous system being treated. This can allow better control and adjustment of the biocide levels in the treated system water.

The following examples are presented to illustrate the present invention and to assist one of ordinary skill in making and using the same. The examples are not intended in any way to otherwise limit the scope of the invention. All percentages are by weight unless otherwise noted.

EXAMPLES

Reference is made in the following to a number of illustrative examples of the present and compositions. The following embodiments should be considered as only an illustration of such methods and compositions and should not be considered to be limiting in any way.

Unless otherwise indicated, the corrosion inhibition tests described herein were conducting in an apparatus consisting of a circulation loop with the return water line aerated before entering the sump. FIG. 1 shows a schematic depiction of the system used to conduct the corrosion tests described herein. This system provided the oxygen to simulate cooling tower water conditions. The flow rate was 7.0 gallon per minute in 1" clear PVC piping for ease of visual inspection, corresponding to a linear velocity of 3.2 feet per second. This is in the range of accepted flow rates typically used for corrosion coupon racks in laboratory experiments. The temperature for each run was maintained at 95° F. (35° C.), with the heat provided by the main circulation pump and booster pump. Synthetic water was used to simulate both a scaling and corrosive environment. The synthetic water quality for high hardness waters is shown in Tables 1 and 2. Scale was controlled during each run by the addition of either 1-hydroxyethane-1,1-diphosphonic acid (HEDP) or polymaleic acid and a phosphate/iron dispersant copolymer (AA/AMPS copolymer). The active amounts of scale inhibitors are shown in Tables 1 and 2. The equilibrium pH for each run under high hardness synthetic water conditions was 8.7 to 8.9. This was the natural result of the amount of synthetic bicarbonate alkalinity added, the temperature, aeration, and test run duration.

During the tests in the circulation loop test system chlorine levels were maintained in the synthetic waters through the automatic addition of a bleach solution based on an ORP probe. After 24 hours of a test run, the ORP set point was increased by 100 mV. The free and total chlorine levels were intentionally high at 0.5-1.5 and 1.0-2.5, respectively, to simulate a system that did not have good control, as can be often be found in field conditions. This also provided circumstances that were conducive to comparing inhibitors to a control. Test runs were five days long during which mild steel and copper Corrator™ probe data was collected. Appearance of corrosion coupons was also observed. Most of the tests were run using the high hardness synthetic water (shown in Table 2) that was both corrosive and scaling. Other tests runs were done using a water that would be considered low hardness to simulate a soft water system.

New carbon steel coupons and Corrator™ probe tips were used for test each run. All coupons and tips were not passivated prior to an experimental run. Each test consisted of a five day run at which time pictures were taken of the carbon steel coupon and Corrator™ probe data was graphed. A copper coupon was also installed in the loop for each run to provide a source of potential free copper to more closely simulate a mixed metallurgy cooling water system. Tolyltriazole was added to the system to minimize corrosion of the copper coupon. This was done to further mimic actual field conditions. No other metallurgy was present in the system; all fittings were schedule 80 PVC. The system was cleaned between runs with citric acid and rinsed thoroughly. The rating of an inhibitor was determined based on the appearance of the coupon and the Corrator™ probe graphs.

Coupon Analysis

Due to the short five day exposure time of each trial, coupon analysis was limited to qualitative observations. Such results can provide a visual comparison between the corrosion inhibitors tested. The tolyltriazole present in each trial may have provided some minor protection for carbon steel either by limiting free copper in the system or as a complimentary carbon steel corrosion inhibitor.

Corrator™ Probe Analysis

This type of corrosion analysis provides graphical results that depict a quantitative representation for the full five day test run. The two-channel Corrator™ probe output provided continuous results on general corrosion and the pitting potential, which is referred to as the imbalance. Addition of oxidizing biocide produced large variability in the data sets. Graphical smoothing of the data was performed for ease of comparing the different Corrator™ probe data sets. The raw data showed spikes in the copper corrosion corresponding to hypochlorous acid additions.

Example 1

A five day corrosion test was run in the corrosion testing circulation loop under the conditions described above. The hard hardness synthetic water employed in the test is shown in Table 1. Scale was controlled during each run by the addition of 1-hydroxyethane-1,1-diphosphonic acid (HEDP) and a phosphate/iron dispersant copolymer (AA/AMPS copolymer). Tolyltriazole was added to the system to minimize corrosion of the copper coupon installed in the loop to provide a potential source of free copper. The various treatments being tested were only added to the synthetic system water at the beginning of the test. Contrary to the common practice in actual industrial applications designed to control corrosion during ongoing operating conditions, no effort was made to measure or maintain the level of the inhibitor treatment throughout the course of the test.

As with the Corrator™ probe results (not shown), the corrosion coupon results with the molybdate (result not shown) and phosphate/polyphosphate (TSP/TKPP) inhibitors provided the least mild steel corrosion protection under the conditions of the test and the inhibitor dosages used (see FIG. 2). The phosphate/zinc inhibitor exhibited good control. The best mild steel corrosion control was observed with moderately high concentrations (15 ppm) of commercial hydroxyphosphonic acid (HPA) and phosphonocarboxylic acid (PCA) corrosion inhibitors. Even when tested at a substantially higher dose (30 ppm), polyaspartic acid (AAP) exhibited an inferior level of mild steel corrosion control under the test conditions.

TABLE 1

High Hardness Synthetic Water A.

| Item | Concentration | Unit (ppm) |
|---|---|---|
| Ca | 543 | $CaCO_3$ |
| Mg | 140 | $CaCO_3$ |
| $HCO_3$ | 328 | $CaCO_3$ |
| Cl | 114 | Cl |
| $SO_4$ | 505 | $SO_4$ |
| HEDP | 3 | Active |
| Copolymer | 8 | Active |
| Tolyltriazole | 3 | Active |

Example 2

A five day corrosion test was run in the corrosion testing circulation loop under the conditions described above. The high hardness synthetic water employed in the test is shown in Table 2. Scale was controlled during each run by the addition of polymaleic acid and a phosphate/iron dispersant copolymer (AA/AMPS copolymer). Tolyltriazole was added to the system to minimize corrosion of the copper coupon installed in the loop to provide a potential source of free copper. As with the other tests run in the corrosion testing circulation loop, the various treatments being tested were only added to the synthetic system water at the beginning of the test run. No effort was made to measure or maintain the level of the inhibitor treatment through the course of the test.

TABLE 2

High Hardness Synthetic Water B.

| Item | Concentration | Unit (ppm) |
|---|---|---|
| Ca | 543 | $CaCO_3$ |
| Mg | 140 | $CaCO_3$ |
| $HCO_3$ | 328 | $CaCO_3$ |
| Cl | 114 | Cl |
| $SO_4$ | 505 | $SO_4$ |
| Polymaleic Acid | 8.5 | Active |
| Copolymer | 8 | Active |
| Tolyltriazole | 3 | Active |

Figures 3, 4:
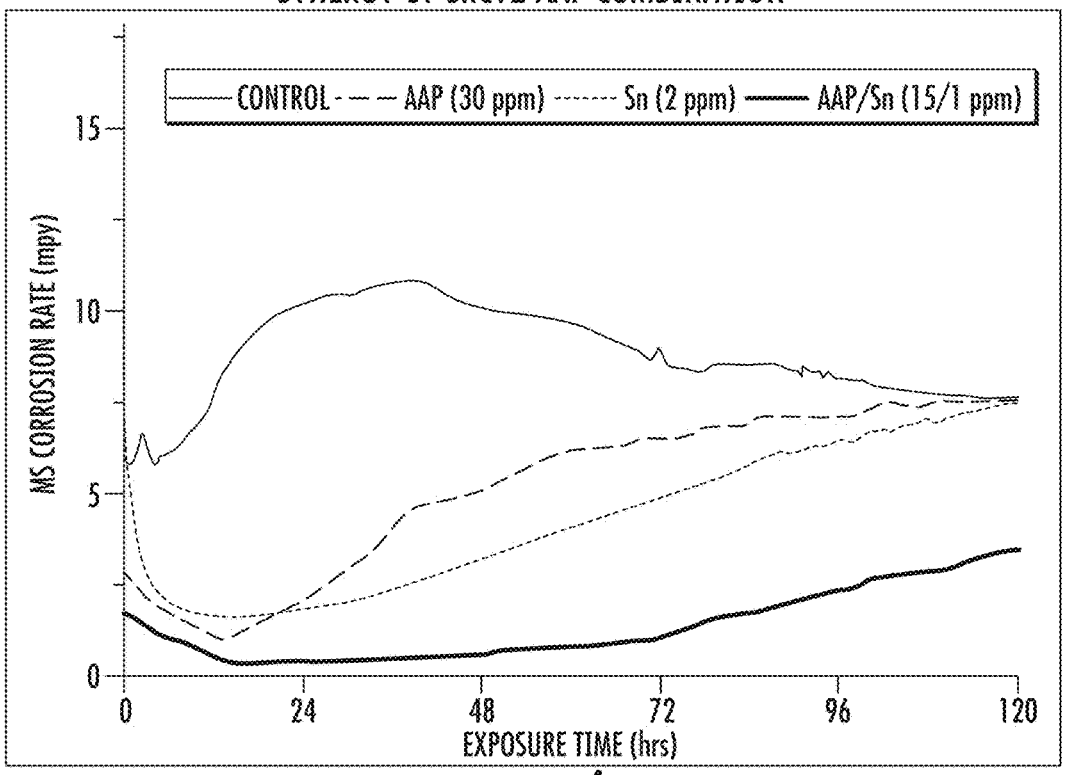
FIG. 3 depicts mild steel corrosion coupon results in a comparison of a two commercial phosphonocarboxylic acid corrosion inhibitors (PCM and EPOC) versus polyaspartic acid (AAP) from a test conducted in Hard Water B.
FIG. 4 shows a comparison of mild steel corrosion rates measured with a Corrator™ probe for a Sn/AAP combination treatment versus treatments with the individual components used alone.

Test runs were conducted using polyaspartic acid (AAP), a commercial phosphonocarboxylic acid mixture (PCM), hydroxyphosphonic acid (HPA), polyamino-phosphonate (PAP), and enhanced phosphono-carboxylate (EPOC). FIG. 3 illustrates the results observed with mild steel corrosion coupons for some of these inhibitors under these test conditions.

There was little phosphate in the system at the start of each run and any orthophosphate at the end of a test run was due to the reversion of organic phosphonate to orthophosphate. The azole level at the beginning of each run was 3 ppm. The reduction of azole is due to its susceptibility to oxidation under higher sustained ORP levels. The AAP that was used was reported to contain a small amount of phosphate resulting from the manufacturing process. Reversion of an organic phosphate inhibitor to orthophosphate represents a change from an organic program toward an inorganic program, which could affect the overall green status of the program or its performance. Orthophosphate is reportedly not as good at inhibiting mild steel corrosion as organic phosphate, especially at low levels. Performance of an orthophosphate program may also be reduced due to increased scaling potential of calcium phosphate.

Although the system containing EPOC shows the least deterioration of azole, the reversion of organic phosphate to orthophosphate was quite high. Conversely, PCM shows minimal reversion to orthophosphate, but coincides with a high loss of azole in the system. HPA/MEA and PAP coincided with less azole deterioration than PCM, but this may be due to the higher ratio of total chlorine to free chlorine provided by the amine functionality of these inhibitor combinations. Even though MEA was added to the HPA in an attempt to minimize reversion to orthophosphate, the reversion over the five day test period at continuously elevated oxidation levels was substantial.

TABLE 3

Orthophosphate and azole residuals after 5 day test.

| Inhibitor | Orthophosphate (ppm $PO_4$) | Azole (ppm TTA) |
|---|---|---|
| AAP | 0.50 | 0.00 |
| HPA/MEA | 9.30 | 0.90 |
| PAP | 5.00 | 0.70 |
| PCM | 0.25 | 0.40 |
| EPOC | 4.72 | 1.70 |

Due to the shortened five day exposure time of each trial, corrosion coupon analysis was limited to qualitative observations. The results, shown in FIG. 3, provide a visual comparison between corrosion inhibitors (only results with AAP, PCM and EPOC are shown). Under the test conditions outlined in the experimental procedure, the carbon steel inhibitor performance can be ranked as follows:

EPOC≈PCM>PAP≈HPA/MEA>>AAP

Both the AAP and control coupons have been plated with copper and Table 3 indicates that the AAP test had no residual azole after five days. This provides a strong indication that the 3 ppm azole in these systems had been degraded by the hypochlorous acid additions. Once the azole is depleted, there is no remaining inhibitor to provide substantial protection of the copper corrosion coupon. The copper released plates on the surface of the mild steel coupon. The other inhibitors in the test did not show this copper plating effect. Overall, the results indicated that when used at levels comparable to commercial organophosphonate corrosion inhibitors (15 ppm), polyaspartic acid (AAP) is a substantially inferior corrosion inhibitor.

Example 3

A five day corrosion test in the corrosion testing circulation loop under the conditions described above was conducted to compare the effectiveness of a polyaspartic acid/tin combination treatment versus higher levels of each of the individual components used alone. Stannous chloride was used as the tin source. The polyaspartic acid (AAP) was applied at 30 ppm when used alone. Stannous chloride levels of 2, 3 and 6 ppm (expressed as ppm tin) were tested. The polyaspartic acid/tin combination treatment was tested at a level of 15 ppm AAP/1 ppm tin. As with the other tests run in the corrosion testing circulation loop, the various treatments being tested were only added to the synthetic system water at the beginning of the test run. No effort was made to measure or maintain the level of the inhibitor treatment through the course of the test. During the course of the test runs the pH of the water changed, rising from an initial level of 7.5 to about 8.5.

The high hardness synthetic water employed in the test is shown in Table 2. Scale was controlled during each run by the addition of polymaleic acid and a phosphate/iron dispersant copolymer (AA/AMPS copolymer). Tolyltriazole was added to the system to minimize corrosion of the copper coupon installed in the loop to provide a potential source of free copper.

Figure 5:
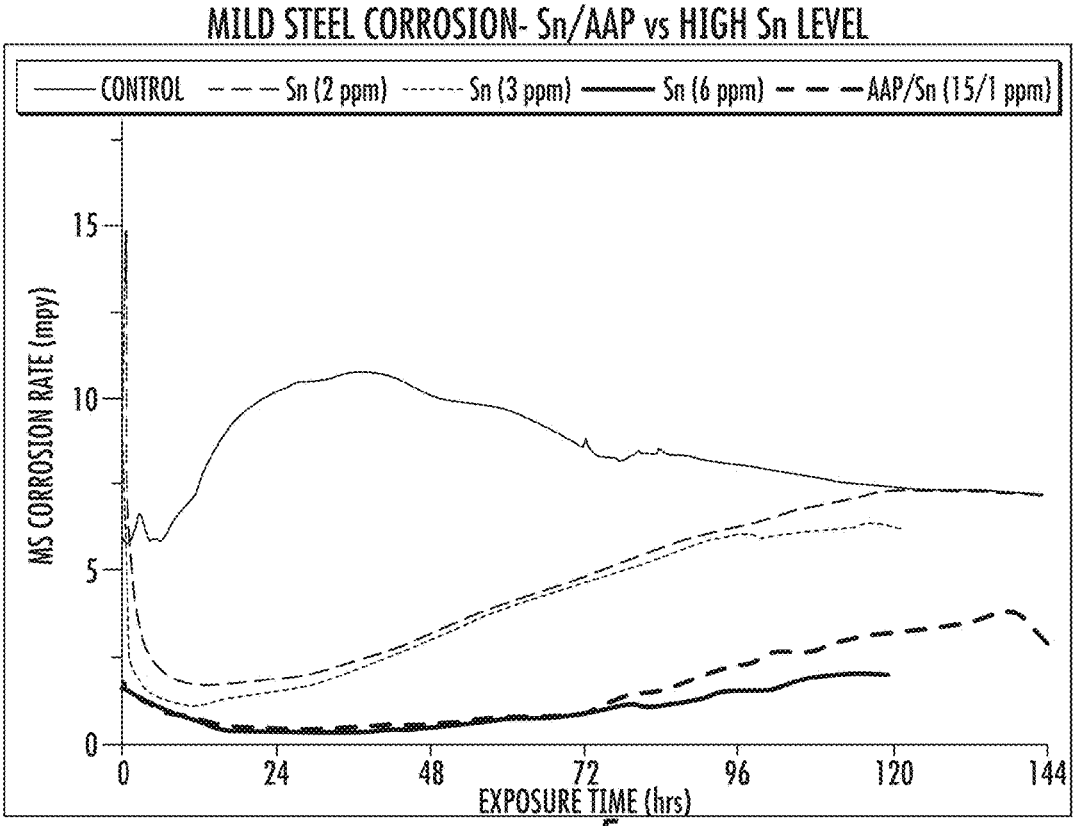
FIG. 5 shows mild steel corrosion rates in high hardness water measured with a Corrator™ probe for a Sn/AAP treatment (1/15 ppm) in comparison to treatments with higher levels of a stannous salt (2, 3 or 6 ppm Sn).
Figure 6:
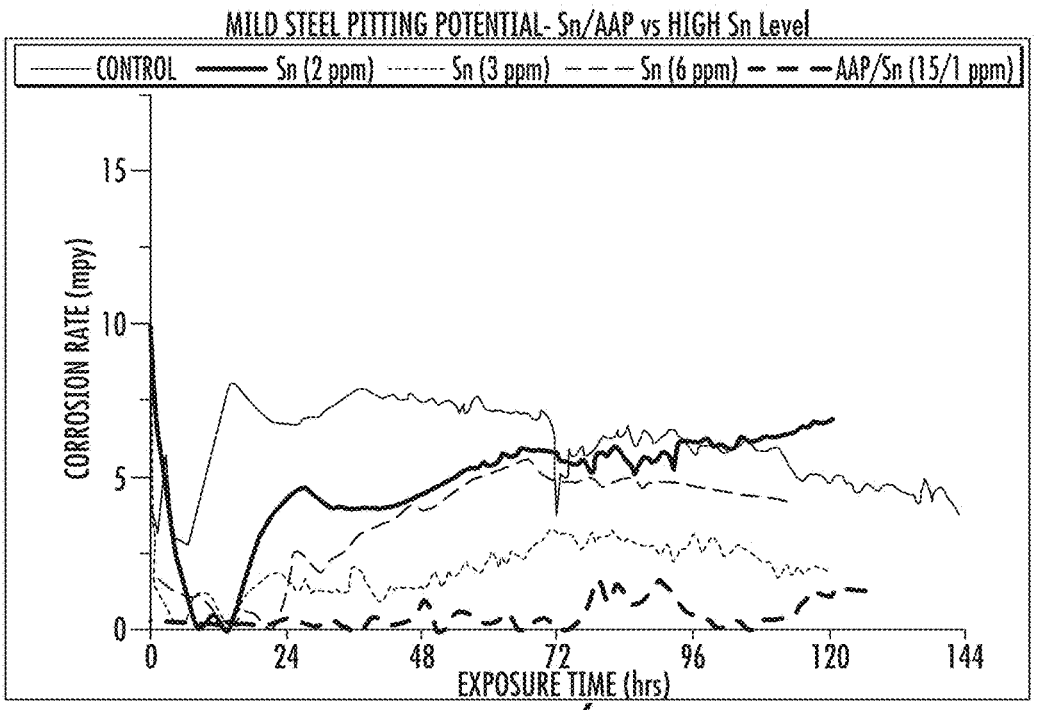
FIG. 6 shows mild steel pitting potential in high hardness water measured with a Corrator™ probe for a Sn/AAP treatment (1/15 ppm) in comparison to treatments with higher levels of a stannous salt (2, 3 or 6 ppm Sn).

FIGS. 4-6 show mild steel Corrator™ probe corrosion results from the testing. The results indicate that the Sn/AAP combination exhibits a synergistic effectiveness as a corrosion inhibitor when compared to the High Sn level treatment and the high polyaspartic acid (30 ppm AAP) application. These results are borne out by both the mild steel Corrator™ probe corrosion rates (FIGS. 4 and 5) and well as the mild steel pitting potential results shown in FIG. 6.

FIG. 4 shows the measured corrosion rates from four of the tests. First, the control coupon, with neither tin nor polymer present, resulted in very high corrosion rates (5-10 mpy) throughout the test. Polyaspartic acid polymer was tested by itself at 30 ppm (as polymer actives), after an initial high flash corrosion rate of 3-5 mpy, dropped to below 2 mpy during the first 16 hours, but then rose and exceeded 5-7 mpy for the final three days. When tin was tested by itself at 2 ppm as Sn, the initial flash corrosion dropped to about 2 mpy, but then climbed steadily and reached about 7 mpy by the end of the test. The test that was run using the combination of 15 ppm AAP and 1 ppm tin demonstrated superior results. The corrosion rate dropped very rapidly such that the initial flash corrosion was barely detectable. Within 12 hours, corrosion was still less than 1 mpy, remained at a very low level for over three days, then slowly increased, but the corrosion rate barely reached 3 mpy by the end of the test. Because such superior results are observed, even though both components are present at much lower concentrations, the synergistic effect of the combination is clearly demonstrated.

Example 4

A five day corrosion test in the corrosion testing circulation loop under the conditions described above was conducted to compare the effectiveness of a polyaspartic acid/tin combination treatment (15 ppm AAP/1 ppm tin) versus a conventional stabilized phosphate (TSP/TKPP) product. The composition of the two treatments (expressed as the final concentrations as diluted in the system water) is shown below. Stannous chloride was used as the tin source. As with the other tests run in the corrosion testing circulation loop, the various treatments being tested were only added to the synthetic system water at the beginning of the test run. No effort was made to measure or maintain the level of the inhibitor treatment through the course of the test. A synthetic high hardness water having the same composition as the test water shown in Table 2 was employed.

Stabilized Polyphosphate Treatment

Polymaleic Acid Polymer=17.7 ppm product=8.5 ppm PMA

AA/AMPS Copolymer=17.7 ppm product=8 ppm AA/AMPS

TT-50=7 ppm product=3 ppm TT

TSP=17.6 ppm product=4.4 ppm PO4

TKPP=10 ppm product=5.6 ppm PO4

Sn/AAP Combination Treatment

Polymaleic Acid Polymer=17.7 ppm product=8.5 ppm PMA

AA/AMPS Copolymer=17.7 ppm product=8 ppm AA/AMPS

TT-50=7 ppm product=3 ppm TT

Aspartic Acid Polymer=37.5 ppm product=15 ppm AAP

SnCl2=1.6 ppm product=1 ppm Sn

Figure 7:
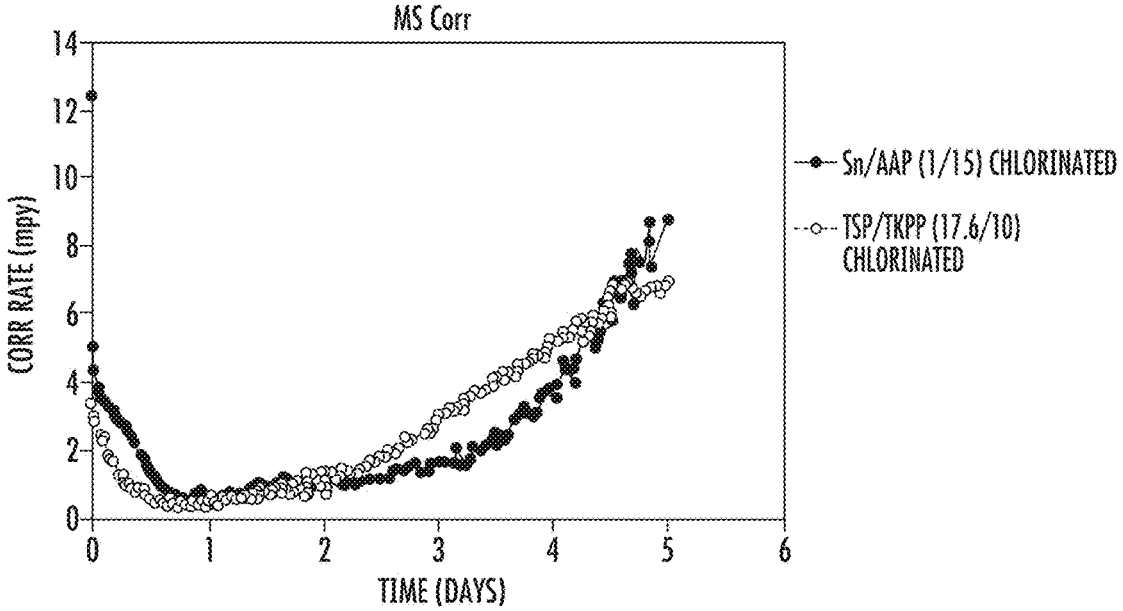
FIG. 7 shows mild steel corrosion rates measured with a Corrator™ probe for a comparison of a Sn/AAP combination treatment versus a conventional stabilized polyphosphate (TSP/TKPP) product in a high hardness water.
Figure 8:
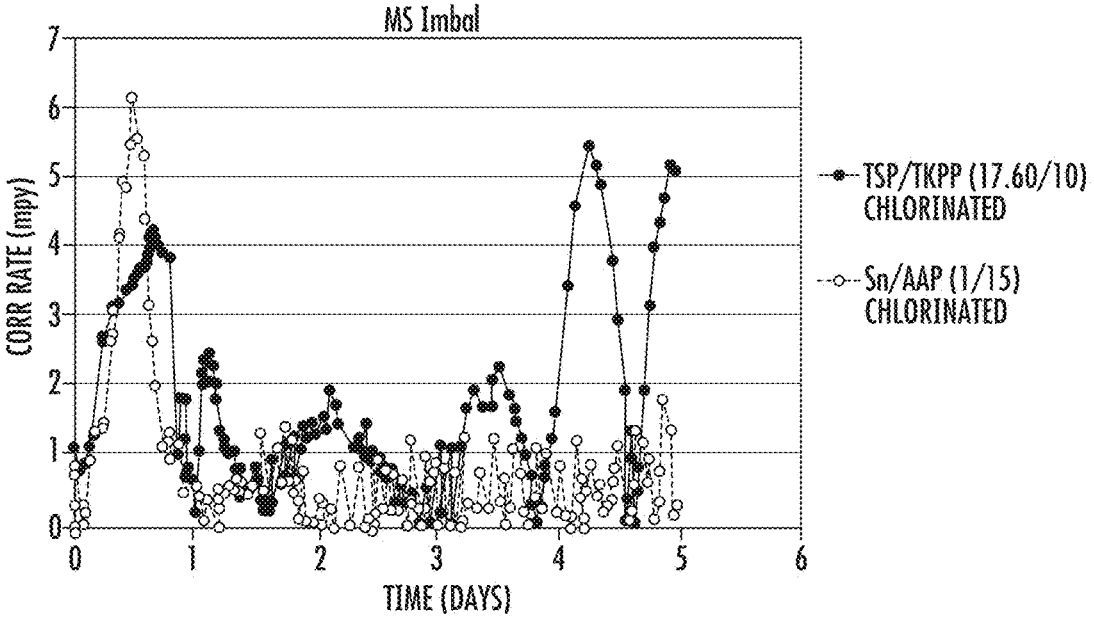
FIG. 8 shows mild steel pitting potential measured with a Corrator™ probe for a comparison of a Sn/AAP combination treatment versus a conventional stabilized polyphosphate (TSP/TKPP) product in a high hardness water.

FIG. 7 shows mild steel corrosion rates measured with a Corrator™ probe for the Sn/AAP combination treatment versus the conventional stabilized phosphate (TSP/TKPP) product in the high hardness water. FIG. 8 shows mild steel pitting potential measured with a Corrator™ probe for the same test runs. The mild steel corrosion rates in FIG. 7 demonstrate that both treatments initially provide very good control and low corrosion rates. The Sn/AAP Tin treatment maintains a corrosion rate of about 1 mpy or less through the first three days of the test, longer than the conventional stabilized phosphate treatment. The mild steel pitting potentials shown in FIG. 8 demonstrate that the pitting potential for the Sn/AAP treatment remains low throughout the 5 day test. In contrast, the stabilized phosphate treatment exhibited much more variability and spikes to higher pitting potentials. Overall, these results demonstrate that the Sn/AAP treatment provides at least comparable and in some cases superior corrosion control in contrast to the conventional stabilized phosphate treatment.

Example 5

An additional test was performed in an industrial cooling water system having a low hardness water quality. The composition of the system water quality is shown in Table 4 below. The system water included about 2 to 3 ppm phosphate (PO4), presumably introduced by makeup water added to the system. This test demonstrated the effectiveness of a polyaspartic acid/tin combination treatment (at circa 20 ppm AAP/1 ppm tin) over the duration of one month. During the month long test, the phosphate (PO4) levels in the system waters remained about the same. The polyaspartic acid/tin treatment included the indicated levels of these components as well as a polymaleic acid scale inhibitor, an AA/AMPS copolymer (a phosphate/iron dispersant), tolyltriazole and citric acid. During the course of the month-long test, the level of treatment in the system was maintained through periodic addition of additional corrosion inhibitor.

TABLE 4

Low Hardness System Water.

| Item | Concentration | Unit (ppm) |
|---|---|---|
| Ca | 8.7 | CaCO3 |
| Mg | 17.3 | CaCO3 |
| Tot Alkalinity | 1,300 | CaCO3 |
| Cl | 207 | Cl |
| SO4 | 81 | SO4 |
| Br | 22 | Br |
| Silica | 50 | SiO2 |
| Na | 453 | Na |
| o-PO4 | 1.8-2.9 | PO4 |

Figure 9:
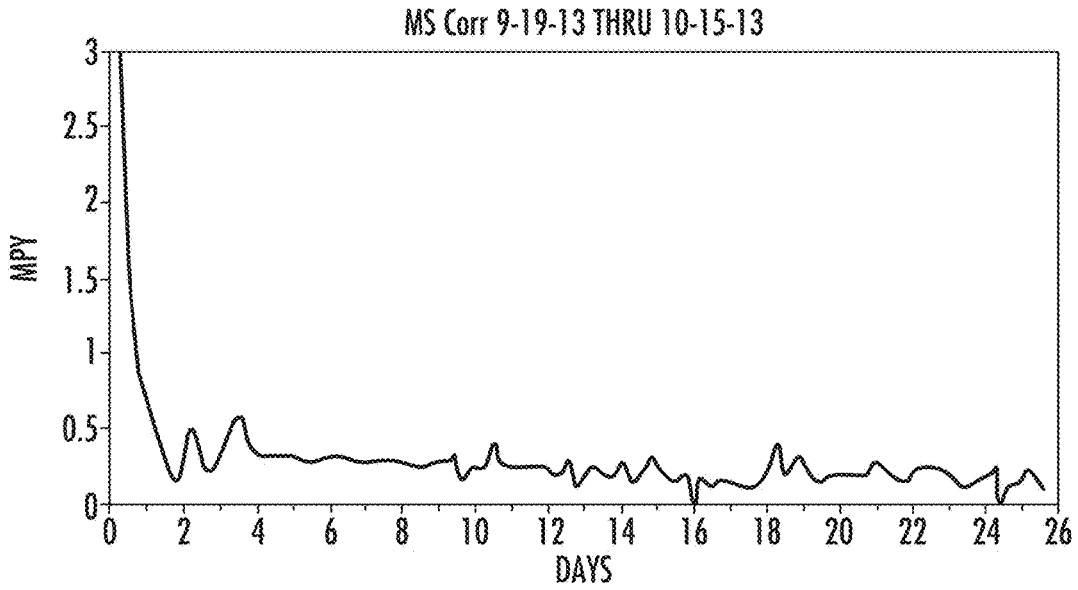
FIG. 9 shows mild steel corrosion rates measured with a Corrator™ probe in an experimental trial run in an industrial cooling water system treated with a Sn/AAP combination treatment.
Figure 10:
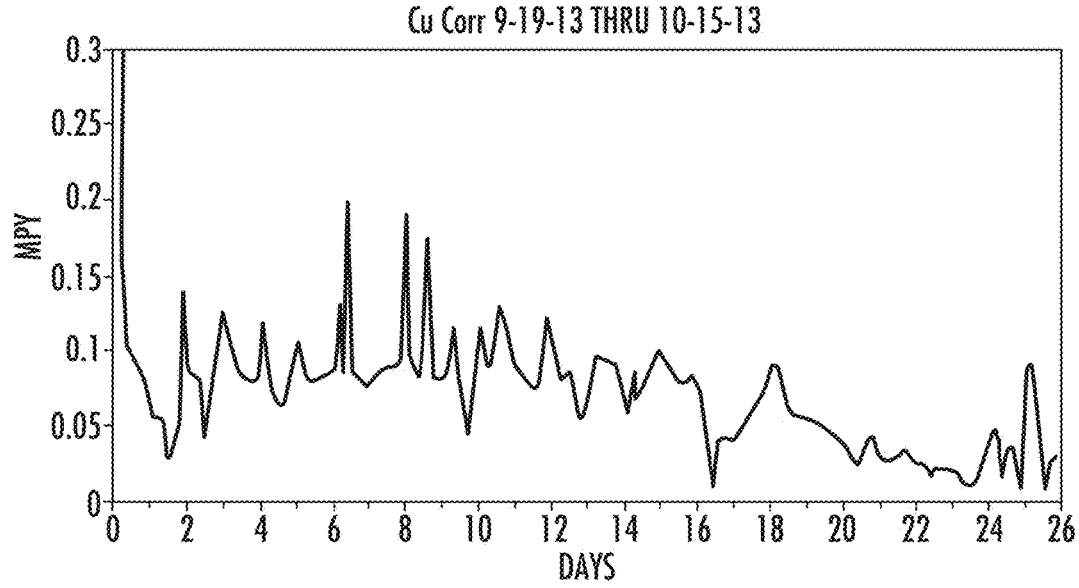
FIG. 10 shows copper corrosion rates measured with a Corrator™ probe in an experimental trial run in an industrial cooling water system treated with a Sn/AAP combination treatment.
Figure 11:
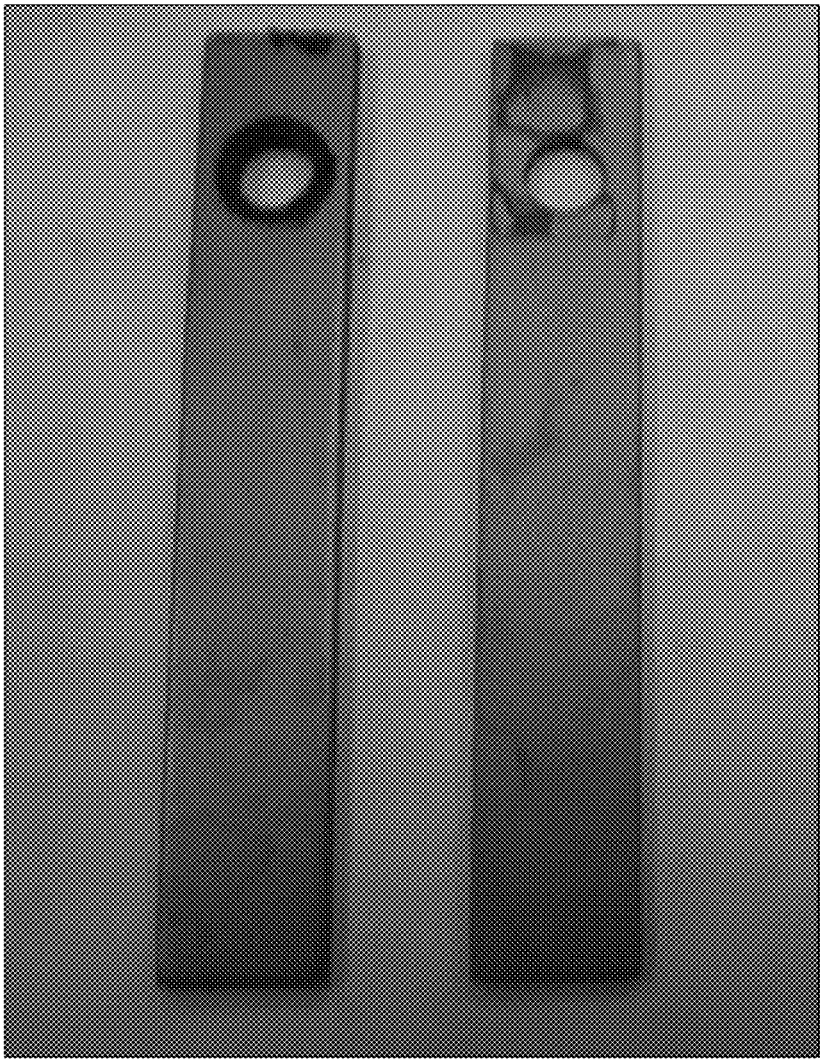
FIG. 11 shows mild steel and copper corrosion coupon results from the experimental trial run in an industrial cooling water system treated with a Sn/AAP combination treatment.

FIGS. 9 and 10 show mild steel and copper corrosion rates, respectively, measured with a Corrator™ probe for the Sn/AAP combination treatment in the low hardness water. The mild steel corrosion rates in FIG. 9 demonstrate that the treatment provides low corrosion rates and excellent corrosion control throughout the duration of the month long test. As shown in FIG. 10, the treatment also provides a low rate of copper corrosion. FIG. 11 shows the mild steel (left) and copper (right) corrosion coupons have little visual evidence of corrosion after the month long test. This is corroborated by the corrosion rates determined by the weight loss method for these coupons (see Table 5 below). Overall, these results demonstrate that the Sn/AAP treatment provides excellent corrosion control in a low hardness system water—comparable to that observed in previous Examples.

TABLE 5

Coupon Corrosion Rates.

| Treatment Dosage (ppm Active) | Coupon Metal | Corrosion Rate (mpy) |
|---|---|---|
| Sn/AAP (0.9/19.7) | Mild Steel | 1.014 |
| Sn/AAP (0.9/19.7) | Copper | 0.054 |

Illustrative Embodiments

Reference is made in the following to a number of illustrative embodiments of the subject matter described herein. The following embodiments describe illustrative embodiments that may include various features, characteristics, and advantages of the subject matter as presently described. Accordingly, the following embodiments should not be considered as being comprehensive of all of the possible embodiments or otherwise limit the scope of the methods, materials and compositions described herein.

One embodiment provides a corrosion inhibiting composition which includes effective amounts of (a) an amino acid-based polymer, such as a polyaspartic acid compound; and (b) dispersible and/or soluble tin compound. The corrosion inhibiting composition may typically include effective amounts of (1) a polyaspartic acid compound; and (2) tin salt(s) and optionally (3) a polycarboxylic acid chelating agent. The corrosion inhibiting composition may also include at least one additional component selected from the group consisting of (meth)acrylic polymers, acrylic/sulfonic copolymers, polymaleic acid, and acrylic/maleic copolymers. The composition may include about 0.1 to 10 wt. % of the tin compound and about 1 to 40 wt. % of the amino acid-based polymer. Quite commonly, the corrosion inhibiting composition may include about 0.2 to 5 wt. % and often about 0.5 to 3 wt. % of the tin compound, and about 5 to 25 wt. % and often about 10 to 20 wt. % of the amino acid-based polymer. For some applications, it may be advantageous to use a corrosion inhibitor treatment that is substantially free of organophosphonate compounds and phosphate and polyphosphate materials. Often, the present corrosion inhibiting compositions are desirably substantially free of heavily regulated metals, such as chromate, zinc and molybdate.

In one embodiment, the present application provides a method of inhibiting corrosion of one or more metals in contact with an aqueous system, where the method comprises maintaining effective amounts of (a) an amino acid-based polymer, such as polyaspartic acid, and (b) dispersible and/or soluble tin compound in the aqueous system. Such aqueous systems very often have a pH in the range of about 7 to 10. The corrosion inhibiting components employed in the present method may be added simultaneously or separately into the water of the aqueous system, i.e., provided either in a single treatment product or as separate products. The method typically includes adding a corrosion inhibitor composition to the aqueous system, where the composition includes a polyaspartic acid compound and a water soluble tin salt, e.g., a water soluble stannous salt. The corrosion inhibitor composition may optionally include a polycarboxylic acid chelating agent and/or an acrylic/sulfonic copolymer. In the method, the levels of the tin and the amino acid-based polymer in the aqueous system are typically maintained at about 0.1 to 10 ppm (expressed as tin, e.g., the equivalent of ~0.16-16 ppm stannous chloride) and about 1 to 50 ppm, respectively. Quite commonly, the method may include maintaining about 5 to 25 ppm polyaspartic acid and about 0.2 to 5 ppm tin, e.g., introduced in the form of stannous chloride, in the aqueous system in contact with the metal(s).

In one embodiment, a method of inhibiting corrosion of one or more metals in contact with an aqueous system is provided where the method includes adding corrosion inhibiting effective amounts of (1) an amino acid-based polymer and (2) dispersible and/or water soluble tin compound to the aqueous system. Commonly, the aqueous system has a pH in the range of about 7 to 10 and may have a hardness within the range of about 10 to 1,200 (expressed as ppm $CaCO_3$). Very often, the amino acid-based polymer includes a polyaspartic acid compound, such as polyaspartic acid. The tin compound commonly includes a soluble tin salt, such as a water soluble stannous salt. For example, the method may include adding the tin salt and the polyaspartic acid compound to the aqueous system in a weight ratio of about 1:5 to 1:50. Very often the method results in producing concentrations of about 0.2 to 5 ppm (expressed as ppm tin) of a tin salt and about 1 to 50 ppm of the amino acid-based polymer, such as a polyaspartic acid compound, in the aqueous system. The metals in contact with the aqueous system may include a ferrous metal, copper and/or a copper alloy, aluminum and/or an aluminum alloy. The metals in contact with the aqueous system may also be lead or solder. Typically the aqueous system is in contact with a ferrous metal and, optionally, copper and/or a copper alloy. The aqueous system may be an open recirculating cooling system, a closed loop cooling system, a closed loop heating system, a boiler system, a water sprinkling system, and/or a distribution system for washwater, drinking water, irrigation water, or firefighting water. In particular embodiments, the tin compound may be include a stannous salt, such as stannous chloride. The concentration of the stannous salt in the water to be treated may be at a final diluted concentration so as to provide about 0.1 to 50 ppm, commonly about 0.1 to 10 ppm and often about 0.2 to 5 ppm and suitably about 0.5 to 3 ppm tin in the aqueous system (expressed as tin, e.g., 0.6 ppm "tin" is the equivalent of about 1.0 ppm stannous chloride).

One embodiment provides a corrosion inhibiting composition which includes effective amounts of (a) a polyaspartic acid compound; and (b) tin salts. The tin salts typically include a stannous salt, e.g., a water soluble stannous salt, such as stannous chloride. In some embodiments, the tin salt may include a stannic salt. The composition may include about 0.1 to 10 wt. % tin salt and about 1 to 40 wt. % of the polyaspartic acid compound. Quite commonly, the corrosion inhibiting composition may include about 0.2 to 5 wt. % and often about 0.5 to 3 wt. % tin, and about 5 to 25 wt. % and often about 10 to 20 wt. % of the polyaspartic acid compound. The corrosion inhibitor composition may optionally include a polycarboxylic acid chelating agent, such as citric acid and/or polymaleic acid, and/or an acrylic/sulfonic copolymer, such as an AA/AMPS copolymer. The weight ratio of the tin salt(s) to the polyaspartic acid compound in the corrosion inhibitor composition is suitably about 1:5 to 1:50 and often about 1:10 to 1:25.

Another embodiment provides a corrosion inhibiting composition comprising: (1) polyaspartic acid compound; and (2) a dispersible and/or water soluble tin compound. The composition may further comprise a polycarboxylic acid chelating agent and/or a carboxylate/sulfonate functional copolymer. For example, the corrosion inhibiting composition may include polyaspartic acid; a tin salt, such as stannous chloride; a polycarboxylic acid chelating agent, such as citric acid and/or polymaleic acid; and a carboxylate/sulfonate functional copolymer, such as an acrylic acid/AMPS copolymer. Such compositions may include about 0.3 to 2 wt. % tin (e.g., about 0.5 to 3 wt. % of a tin salt), about 10 to 25 wt. % polyaspartic acid, about 2 to 20 wt. % citric acid and/or polymaleic acid and about 5 to 20 wt. % AA/AMPS copolymer. In many instances, the weight ratio of the tin salt(s) to the polyaspartic acid is suitably about 1:5 to 1:50 and often about 1:10 to 1:25.

It will be readily apparent to one skilled in the art that varying substitutions and modifications may be made to the methods and compositions disclosed herein without departing from the scope and spirit of the invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention. Thus, it should be understood that although the present invention has been illustrated by specific embodiments and optional features, modification and/or variation of the concepts herein disclosed may be resorted to by those skilled in the art, and that such modifications and variations are considered to be within the scope of this invention.

In addition, where features or aspects of the invention are described in terms of Markush groups or other grouping of alternatives, those skilled in the art will recognize that the invention is also thereby described in terms of any individual member or subgroup of members of the Markush group or other group.

Also, unless indicated to the contrary, where various numerical values are provided for embodiments, additional embodiments are described by taking any 2 different values as the endpoints of a range. Such ranges are also within the scope of the described invention.

What is claimed is:

1. A corrosion inhibiting composition comprising: (1) a polyaspartic acid compound; and (2) tin salt; (3) a polycarboxylic acid chelating agent and (4) a carboxylate/sulfonate functional copolymer;

wherein the polyaspartic acid compound has a molecular weight of about 1,000 to 50,000 Daltons as determined by gel-permeation chromatography; and the composition is substantially free of zinc, molybdate, chromate, organophosphonate compounds, and phosphate and polyphosphate materials.

2. The composition of claim 1 wherein the tin salt comprises a stannous salt.

3. The composition of claim 2 wherein the stannous salt comprises a stannous halide, a stannous sulfate and/or a stannous carboxylate.

4. The composition of claim 1 wherein the polyaspartic acid compound comprises polyaspartic acid and/or a salt thereof.

5. The composition of claim 1 wherein the composition comprises about 0.1 to 10 wt. % of the tin salt and about 1 to 40 wt. % of the polyaspartic acid compound.

6. The composition of claim 1 wherein the polycarboxylic acid chelating agent comprises citric acid and/or polymaleic acid.

7. The composition of claim 1 further comprising an azole corrosion inhibitor.

8. The composition of claim 1 wherein the polyaspartic acid compound comprises a polyaspartic acid having an average molecular weight of about 1,000 to 10,000 Daltons as determined by gel-permeation chromatography.

9. The composition of claim 8 wherein the tin salt comprises a water soluble stannous salt.

10. The composition of claim 9 wherein the water soluble stannous salt comprises stannous chloride; the polycarboxylic acid chelating agent comprises citric acid and/or polymaleic acid; and the carboxylate/sulfonate functional copolymer comprises an acrylic acid/acrylamidosulfonic acid copolymer (AA/AMPS copolymer).

11. The composition of claim 1 wherein the tin salt comprises a stannic salt.

12. The composition of claim 4 wherein the composition comprises about 5 to 25 wt. % polyaspartic acid; about 0.5 to 3 wt. % stannous chloride and/or stannous acetate; and about 2 to 20 wt. % of the polycarboxylic acid chelating agent.

13. The composition of claim 12 comprising about 5 to 20 wt. % of the carboxylate/sulfonate functional copolymer.

14. The composition of claim 13 wherein the composition comprises about 0.5 to 3 wt. % stannous chloride; about 10 to 20 wt. % polyaspartic acid; and the polycarboxylic acid chelating agent comprises citric acid and/or polymaleic acid; and the carboxylate/sulfonate functional copolymer comprises an AA/AMPS copolymer.

15. A corrosion inhibiting composition comprising about 5 to 25 wt. % polyaspartic acid and/or a salt thereof; about 0.5 to 3 wt. % stannous chloride; about 2 to 20 wt. % of a polycarboxylic acid chelating agent, which includes citric acid and/or polymaleic acid; and about 5 to 20 wt. % of a carboxylate/sulfonate functional copolymer, which includes an acrylic acid/acrylamidosulfonic acid copolymer;

wherein the polyaspartic acid has an average molecular weight according to gel-permeation chromatographic analysis of about 1,000 to 10,000 Daltons; and the composition is substantially free of zinc, molybdate, chromate, organophosphonate compounds, and phosphate and polyphosphate materials.

16. The composition of claim 15 further comprising tolyltriazole and/or benzotriazole.

17. The composition of claim 15, wherein the polyaspartic acid has an average molecular weight according to gel-permeation chromatographic analysis of about 2,000 to 7,000 Daltons.

18. The composition of claim 1, wherein the composition comprises about 5 to 20 wt. % polyaspartic acid and/or a salt thereof; about 0.2 to 3 wt. % stannous chloride; about 2 to 20 wt. % citric acid and/or polymaleic acid; and about 5 to 20 wt. % acrylic acid/acrylamidosulfonic acid copolymer.

19. The composition of claim 18 further comprising an azole corrosion inhibitor.

20. The composition of claim 1 comprising a polycarboxylate polymer and/or copolymer.

21. The composition of claim 20, wherein the polycarboxylate polymer or copolymer is a polymer and/or copolymer based on acrylic acid, methacrylic acid and/or maleic acid.

22. The composition of claim 20, wherein the polycarboxylate polymer comprises polyacrylic acid and/or polymaleic acid.

23. A corrosion inhibiting composition comprising: (1) 1 to 40 wt. % polyaspartic acid and/or a salt thereof, wherein the polyaspartic acid has a molecular weight of about 1,000 to 10,000 as determined by gel-permeation chromatography; and (2) about 0.1 to 10 wt. % of a water soluble stannous salt; (3) about 2 to 20 wt. % of a polycarboxylic acid chelating agent, which includes citric acid and/or polymaleic acid; and (4) about 5 to 20 wt. % of a carboxylate/sulfonate functional copolymer, which includes acrylic acid/acrylamidosulfonic acid copolymer;

wherein the composition is substantially free of zinc, molybdate, chromate, organophosphonate compounds, and phosphate and polyphosphate materials.

* * * * *